United States Patent [19]

Giebmanns

[11] Patent Number: 4,468,891

[45] Date of Patent: Sep. 4, 1984

[54] MACHINE FOR POINT GRINDING DRILLS

[75] Inventor: Karl H. Giebmanns, Westport, Conn.

[73] Assignee: ITM International Tool Machines Inc., Westport, Conn.

[21] Appl. No.: 287,879

[22] Filed: Jul. 29, 1981

[51] Int. Cl.[3] ..... B24B 3/26

[52] U.S. Cl. ..... 51/95 WH; 51/288; 51/219 PC

[58] Field of Search ..... 51/288, 95 R, 95 WH, 51/124 R, 219 PC

[56] References Cited

U.S. PATENT DOCUMENTS

| | | | |
|---|---|---|---|
| 1,481,999 | 1/1924 | Elzey | 51/95 WH |
| 2,805,522 | 10/1957 | Dayton | 51/95 R |
| 3,056,243 | 10/1962 | Flanders | 51/288 R |
| 3,209,493 | 10/1965 | Houser | 51/124 R |
| 3,680,263 | 8/1972 | Johnson | 51/288 |
| 3,916,570 | 11/1975 | Caley | 51/95 WH |

*Primary Examiner*—Harold D. Whitehead

[57] ABSTRACT

A method of and machine for point grinding drills by supporting the drill to be pointed in a relatively fixed position and thereafter moving the drill and a bevelled grinding surface relative to each other while rotating the drill about its axis, and by selecting a point of grinding engagement with the bevelled grinding surface a desired lip relief angle may be ground on the drill tip along with a chisel edge angle and a point angle.

9 Claims, 9 Drawing Figures

MACHINE FOR POINT GRINDING DRILLS

BACKGROUND OF THE INVENTION

The present invention relates to a method and machine for pointing drills and more particularly for the grinding of drill ends to grind thereon a lip relief angle, a chisel angle and a point angle each of a selected angular dimension.

Drills or drill bits are manufactured and supplied to users with a general point configuration but without any specific point angle, lip relief angle or chisel angle. Frequently, it is the responsibility of the user to then apply these angles to the drill in accordance with the end use to which the drill is to be put. Thus, one end user may require a specific relationship of angles on the point of its drills to perform a required function while another user may require different combination of angles on its drills for an entirely different purpose.

In some instances, drills already provided by the manufacturer to the user with the required combination of angles, after a period of use, may become worn or damaged. In such instances, it is almost too costly to discard the drills. In such cases, it is less expensive, and at times easier, to regrind the drills to return them to their original condition or to change their desired end configuration. This is especially true in large manufacturing establishments where the replacement cost of drills can constitute an unusually large expense.

Many large manufacturing establishments, therefore, invest in large grinding machines that are used to regrind, grind the drills or "point" drills for reuse. In smaller factories, pointing of drills is still performed by hand by the machinist or user applying a drill gauge to check the ground surfaces of the drills to see whether they met the angular dimensions required. Also such grinding arrangements are used to regrind heavily worn drills.

In an attempt to point and repoint drills, numerous methods and machines have been devised. In the past, the procedures and machines utilized for pointing drills required complicated compound movements of the drill itself across the face of a grinding wheel so as to enable the grinding wheel to produce on the drill end the necessary point angle, lip relief angle and chisel edge angle. The machines were complicated and cumbersome requiring many moving parts that contributed to their early breakdown which resulted in their non-use and down time and subsequent loss of value to the purchaser.

SUMMARY OF THE INVENTION

The desideratum of the present invention is to provide an arrangement of drill pointing that enables the positioning of the drill to be pointed while held in a relatively fixed position. That position is preferably in the vertical. Thereafter, the drill and the grinding surface are caused to move relatively to each other in straight lines with the drill itself being retained in its relatively fixed position so as to avoid compound motions and complex mechanisms that tend to fail and oftentimes produce undesired angles.

In carrying out the desire and objects of the present invention, advantageous features reside in the simplicity of performing the pointing that facilitates the use of simplified structures that are of long wearing characteristics and as a consequence are more efficient in operation, thereby making them easier to utilize and less subject to failure.

BRIEF DESCRIPTION OF THE DRAWINGS

The above description as well as further objects, features and advantages of the present invention, will be more fully appreciated by reference to the following detailed description of a presently preferred, but nonetheless illustrative, embodiment in accordance with the present invention when taken in conjunction with the accompanying drawings wherein.

DETAILED DESCRIPTION

Figure 1:
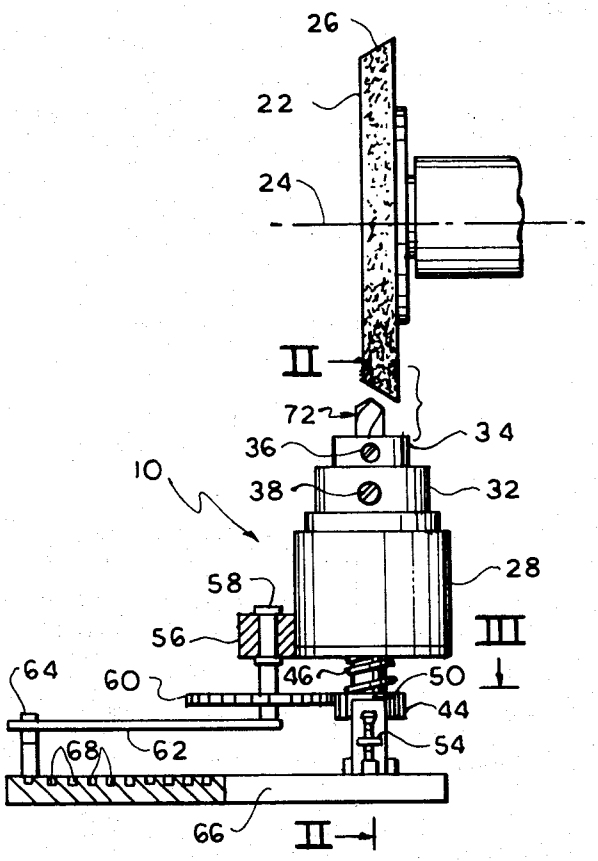
FIG. 1 is a diagrammatic view of a machine in side elevation for pointing drills according to the teaching of the invention with portions thereof shown in section.

Referring now to the drawing, the numeral 10 generally identifies a machine that has been diagrammatically illustrated for the purposes of pointing drills according to the inventive method. The machine 10 is illustrated diagrammatically so that its details may be more clearly seen and easily understood. A more detailed illustration would serve only to encumber an understanding of the method invention and the simple features of construction that may be employed in carrying it out.

Figure 7:
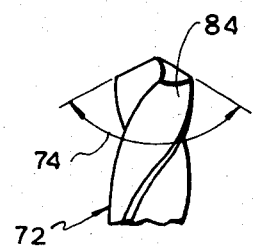
FIGS. 7, 8 and 9 illustrate the point angle, the lip relief angle and the chisel edge angle of the drill respectively.
Figure 8:
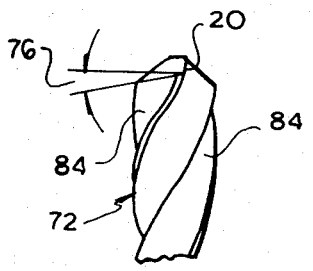
Figure 9:
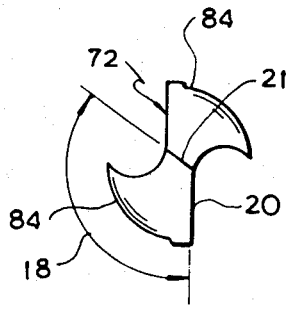

In the pointing of a twist drill of the type illustrated in the drawing and more particularly as generally identified by the numeral 72 in FIGS. 7 to 9, the same includes a point angle as indicated by the double-headed arrow 74 in FIG. 7, a lip relief angle 76 as shown in FIG. 8 and a chisel edge angle 18 as shown in FIG. 9 having a cutting lip 20.

Figure 2:
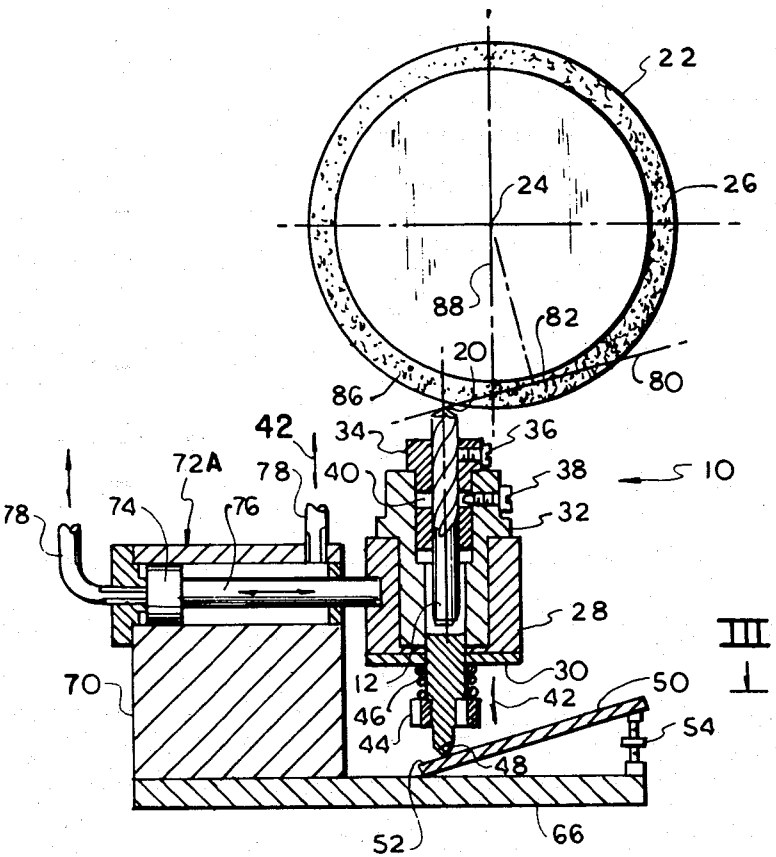
FIG. 2 is a cross-section of FIG. 1 taken along lines 2—2.
Figure 6:
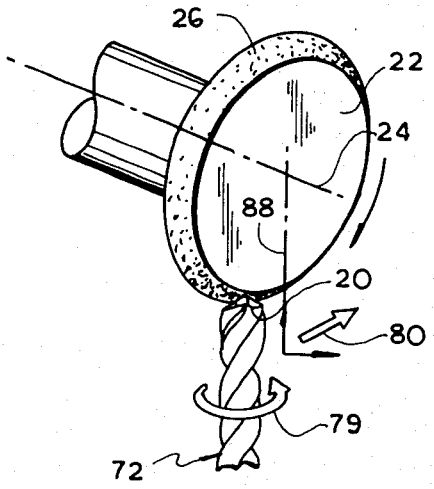
FIG. 6 is a perspective view of the drill in its relationship to the grinding surface according to the invention.

The formation of the combination of aforedescribed angles is accomplished by the use of a grinding wheel 22 that is generally connected to an operating motor that is not shown, but that is rotated about an axis of rotation 24 as may be more clearly seen in FIGS. 1, 2 and 6. The grinding wheel 22 in the present inventive teaching is provided with a bevelled grinding surface 26 of a specific or selected angle. The selection of the angle of bevel of the grinding surface 26 in turn controls the included point angle 74 that will be ground and produced on the end of the drill 72 as illustrated in FIG. 7. When each land of the drill 72 is ground by engagement with the bevelled surface 26, the end of the drill 12 will assume the angular dimensions which have been preselected for the bevel 26 of the grinding surface.

The grinding wheel 22 rotates in a given plane. In the present invention the axis of rotation 24 of the grinding wheel 22 lies in a horizontal plane whereas the grinding wheel is in a vertical plane thereby making it easy to describe the method of of the invention and to understand the operation of a machine functioning according to the method. By positioning the grinding wheel 22 in the vertical plane, the drill to be ground thereby may also be positioned and held in the same plane for engagement with the grinding surface 26 in a manner to be described. However, as the description proceeds, it will become clear that the plane of the grinding wheel 22 is not restricted to the vertical as long as the grinding wheel 22 and the drill 72 move in the same plane.

The present invention is uniquely different from prior art in that the method teaches the retention of the grinding wheel and the drill bit in relatively fixed positions. Other than for the fact that the drill bit and grinding wheel are moved relative to each other for the purpose of grinding engagement with each other during the grinding operation, the only other movement that is effected in the method and a machine for accomplishing it is the rotation of the drill during the grinding operation. Thus, the method teaches a relatively simple set of step procedures for accomplishing the pointing of a drill.

In the present invention, the method is accomplished by a machine that assumes the configuration as illustrated in the diagrammatic drawings. Any other machine structure may be equally adaptable if the same were to follow the method steps of the present invention.

The machine 10 comprises a drill support structure 10 for the drill 12 that includes a housing 28 which is generally tubular in configuration and has a support plate 30 forming a part thereof. Included within the housing 28 is an indexing bushing 32 and a holding bushing 34. Each bushing may be coaxially disposed within the other for convenience of manufacture and assembly. The holding bushing 34 has an internal bore that is of sufficient diameter to receive the drill 12 which is to be pointed. The drill 12 is located with its flutes properly positioned within the bore of the holding bushing by the use of a pin or removable set screw 36.

The indexing bushing 32 includes a similar removable pin or set screw 38 which is intended to be structured similar to that of the set screw 36 for the purpose of indexing the holding bushing to enable the cutting edge 20 of the drill end 72 to be properly oriented with respect to a selected grinding point on the grinding surface 26 of the wheel 22 in a manner to be described. For this reason, therefore, FIG. 2 illustrates the bushing 34 with two diametrically opposed bores or indexing holes 40 each one of which may be selectively engaged by the indexing pin 38 in a manner that will become obvious as the description proceeds.

Although the indexing bushing 32 is provided with a central opening for the receipt of the shank of the drill 12, the depth of such opening is but a matter of choice depending upon the length of the drill to be accommodated therewithin. Let is suffice to note, however, that the indexing bushing 32 is rotatably supported within the housing 28 and extends outwardly therefrom for reciprocating motion as indicated by the double-headed arrow 42 (FIG. 2) and for rotation within the housing and relative to and about its axis in a manner to be described and to be effected at the driven gear 44.

The indexing bushing 32 is biased and normally urged in a downward direction by a coil spring 46 that bears against the supporting plate 30 and on the driven gear 44. The lower end of the indexing bushing is provided with a bearing structure diagrammatically illustrated at 48 for the smooth reciprocating substantially frictionless sliding engagement with an adjustable cam or displacement ramp 50. The cam 50 also is diagrammatically illustrated to be hingedly mounted at 52 at one end and adjustable at its other end 54 by a turnbuckle screw arrangement that may be manually operated to effect a desired inclination of the cam or ramp 50.

As will be obvious from what has already been disclosed, the details of structure are intended to depict a format that may be readily adapted in a more sophisticated arrangement of machine parts that conform with the teaching of the method of the present invention.

Mounted conveniently on a side of the housing 28 is a support block 56 as illustrated in FIG. 1 that rotatably supports a shaft 58 that supports at its lower end a large driving gear 60 which is in engagement with the smaller driven gear 44. The shaft 58 rotates within the block 56 and is caused to rotate by being secured at its lower end with a pivotally mounted arm 62.

The arm 62, at its end remote from its connection with the shaft 58, is guided within a bifurcated yoke 64. The yoke 64 is illustrated for convenience only as being mounted in the base 66 of the machine 10. In the diagrammatic illustration, the yoke 64 is provided with dowel like pins that fit within a series of receiving adjustment holes 68 in the base 66 so as to enable the yoke to be adjusted in its position along and relative to the length of the arm 62 and also along the support plate 66 to thereby control the point of pivot of the arm 62.

Illustrated as mounted on the base 66 is a support block 70 as shown in FIG. 2. The support block 70 is illustrated as conveniently mounting an operating mover 72A that may be in the form of a hydraulic or pneumatic piston cylinder structure. The piston cylinder 72A may comprise a double-headed piston 74 having a rod 76 that may move in opposite directions as is illustrated by the double-headed arrow appearing on the rod 76. Suitable fluid passageways or conduits 78 may be provided to assure the reciprocating flow of gas or liquid into and out of the piston housing of the piston cylinder 72 as indicated by the double arrows in conduits 78.

As described, the drill 12 is mounted in a fixed vertical position in the support 30 with its axis in the vertical plane of rotation of the grinding surface 26 and at least parallel to an imaginary line 88 (FIG. 6) that is drawn vertically through the axis of rotation 24. Although fixed in such position, the drill traverses certain predefined paths of movement. When the pistoncylinder 72A is actuated such that the piston rod 76 shown in FIG. 2 is moved to the right, the support 30 and drill 12 also are moved by it to the right. This causes the bearing 48 on the extension of the indexing bushing 32 to ride upwardly along the cam 50 while the support 30 continues its forward grinding stroke movement to the right. The result is that the drill 12 rises within the support and in opposition to the normal downward urging of the spring 46.

Figure 3:
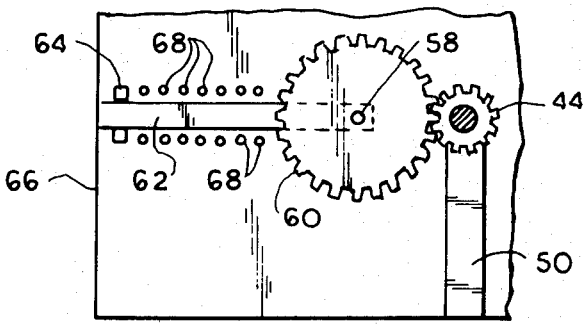
FIG. 3 is a cross-section of FIG. 1 taken along lines 3—3.

During these motions the block 56, which forms a bushing which is rigidly secured on the housing 28, moves the housing and also moves the connected driving gear 60 with it. As the gear 60 moves, it rotates about the axis of the shaft 58. The rotation of gear 60 is transmitted to drive gear 44 which, in turn, rotates the indexing bushing 32 and the drill 12 in the direction 79 (FIG. 6) and as shown by the arrows in FIGS. 4 and 5. The arc of rotation of the drill is variably controlled by the adjusted position of the yoke 64. When the yoke is in the position of FIGS. 3 and 4, the arc of rotation is more than when the yoke 64 is moved closer to the axis of the gear 60.

The method of the invention recognizes the need to be able to provide drills with selectively different lip relief angles 16. In the prior art this was accomplished by various structures which included swinging the drill-lend about its point. Such structures were complicated and cumbersome. Because the method of the present invention teaches the support of the drill in a fixed psition so as to obviate it being subjected to swinging erratic movement, the method teaches the ability to select the lip relief angle to be ground and formed on the drill point by moving the drill relative to the grinding surface 26 and for selective contact with a grinding point 82 on the grinding surface 26 that is spaced at a selected arcuate distance from the dead center or imaginary line 88.

By selecting the location of the point of grinding contact 82 at which the end of the drill 12 engages the grinding surface 26, the practitioner of the method of the present invention is able to control the extent or angular dimension of the lip relief angle 16. To more fully understand how this may be done in a point grinding machine, the machine is diagrammatically illustrated as having the adjustable cam or displacement ramp 50.

The lip relief angle 16 is selectively controlled and capable of being changed by adjustment of the cam surface 50. Because the drill 12 is moved in a direction tangent to the grinding surface 26, its path of movement is controlled by the position of the cam 50 which displaces the drill end in the direction of its axis. As shown in FIG. 2, the tangent path of movement 80 of the drill end is parallel to the angle of the cam 50. At some point during its path of movement, the drill end will come into grinding engagement with the grinding surface 26 at the grinding point 82. This point is selectively controlled by the angle of the cam 50.

Those who are skilled in the art will recognize that the lip relief angle 16 ground on the drill 12 will be greater when the grinding point 82 is spaced an arcuate distance more distant from the dead center line 88 than when the point 82 is located closer to the line 88. By adjustably raising or lowering the cam 50, the user may thereby selectively control the point 82 of grinding engagement between the end of the drill 12 and the surface 26 and thereby control the lip relief angle 16.

In the practice of the invention, the drill is positioned vertically within the support by its location in the bushings 34 and 32. The pin 36 is locked into a flute such that the cutting lip 20 will be perpendicular to the preselected grinding point 82 at the time or moment of its grinding engagement therewith. This assures that at the moment of grinding engagement of the lip 20 with the point 82, the lip will be properly ground and formed.

The preselection of the grinding points 82 will be made in accordance with the dictates of the lip relief angle 16 required to be ground on the drill 12. Hence, the cam 50 will be raised or lowered to effect the exact point of grinding engagement 82 by the drill 12 with the surface 26.

In a similar manner, the angular dimension of the bevel of the grinding surface 26 will be preselected in accordance with the point angle 14 required to be formed on the drill 12. In this case. the bevel angle will be one-half that of the included point 74, since both sides or lands 84 of the drill must be ground at the same angle.

With the grinding wheel 22 turning, the piston-cylinder 72A is actuated so that the piston 74 and its rod 76 are moved to the right into their forward grinding stroke. As the support moves in the direction of raised inclination of the cam 50, the fixedly held and positioned drill 12 is raised toward the bevelled grinding surface 26 along the tangential path 80 that corresponds with and is parallel to the angle of displacement of the ramp 50.

Figure 4:
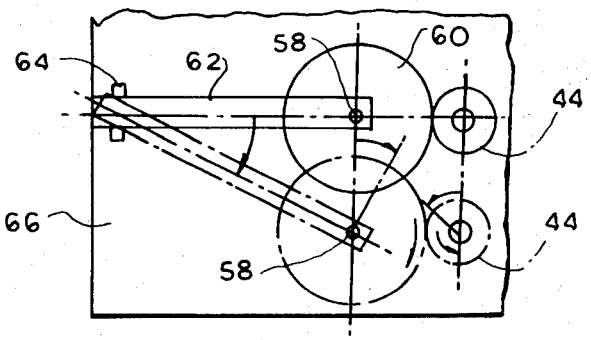
FIGS. 4 and 5 diagrammatically illustrate the operation of a structure for rotating the drill.
Figure 5:
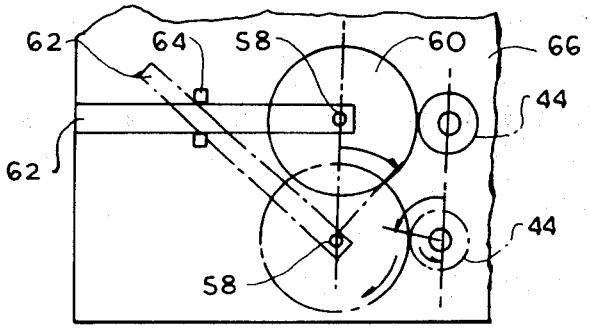

At the same time, the indexing bushing 32 is caused to rotate by reason of the engagement between the gears 44 and 60. The adjusted location of the yoke 64 along the adjustment means 62 will control the arc of rotation of the gears as illustrated in FIGS. 4 and 5. When the yoke is moved closer to the axis of rotation 58 of the gears 60, the arc of its rotation and that of the gear 44 will be increased for the same throw or movement of the piston rod 76.

For drills with lands 84 of greater arcuate extent, the yoke will be adjusted closer to the axis 58 than it will be for lands 84 of smaller arcuate extent. Obviously, the adjustment must be sufficient to assure that the grinding operation will cover the full extent of the lands. Otherwise, the formations of the point angle, the lip relief angles and the chisel edge angles will be incomplete.

When the lip 20 comes into grinding engagement with the point 82, drill 12 has already moved through an arc of rotation. After the lip 20 is ground, the following portion of the land 84 is also ground during its rotative engagement with the grinding point 82. Simultaneously with the rotation of the drill, the drill is being continuously moved in the direction of the grinding point 82 and upwardly along the cam 50. These compound line and rotative movements of the drill assure the complete point grinding and formation of the one land of the drill end.

When the forward grinding stroke is completed, the rod 76 and piston 74 are returned to their starting positon and the drill 12 and its support are returned to the position of that illustrated in FIG. 2. The drill 12 must now be set for the same sequence of steps of be performed on the end to its other land 84. This is accomplished easily by simply removing the pin 38 from its engagement with the bore 40 to enable the 180° rotation of the locating bushing 34.

The released bushing 34 is then rotated or turned until the other bore 40 aligns with the pin 38 that is then set securely therein. There will be provided as many bores 40 equally spaced about the indexing bushing 32 as there are lands to be point ground. In the present illustration the drill 12 has two lands 84; therefore, there will be two corresponding bores 40 angularly spaced from each other by 180°.

When once the drill is again locked into its support in its fixed position, the sequence of steps performed on it will follow exactly the same as those described with respect to its first land. No other changes in steps or equipment are required since both lands 84 of the drill 12 will be identically formed. The same procedure will be performed on each subsequent drill to be pointed with the exception for adjustments that may be made to accommodate desired changes in the point angle or the lip relief angle or the chisel edge angle.

While there have been shown and described and pointed out the fundamental novel features of the invention as applied to a preferred embodiment thereof, it will be understood that various omissions and substitutions and changes in the form and details of the device illustrated and in its operation may be made by those skilled in the art without departing from the spirit of the invention. It is the intention, therefore, to be limited only as indicated by the scope of the claims appended hereto.

We claim:

1. In a machine for pointing the ends of drill, a rotating grinding wheel having a grinding surface defining a body of revolution, a drill support having means to support a drill with the drill axis perpendicular to the axis of rotation of said grinding wheel, means cooperable with said support to cause said support and the drill supported thereby to move toward and away from grinding engagement with a selected point on the body of revolution forming the grinding surface and including means connected with said support to move the same and the drill supported thereby in a direction tangent to said selected point, means on said support operable to rotate the drill about its longitudinal axis in response to the movement of said support toward engagement with said selected point, and said grinding surface being bevelled at an angle coincident with the point angle to be ground thereby on the end of the drill.

2. In a machine as in claim 1, means on said support to locate the cutting lip of the drill perpendicular to the selected point when the drill is in grinding engagement therewith.

3. In a machine as in claim 2, means on said support to index the flutes of the drill to enable each of the lands of the drill to be positioned for grinding engagement with said selected point.

4. In a machine as in claim 1, said displacement means being adjustable to selectively vary the location of the selected point on said grinding surface at which the drill end will engage to thereby selectively control the lip relief angle to be ground on the drill end.

5. In a machine as in claim 1, said grinding surface being in a vertical plane, and said support positioning the drill with its vertical axis in said vertical plane of said grinding surface.

6. In a machine as in claim 1, said operable means being adjustable to vary the arc of rotation of the drill to fully form the chisel edge angle on the drill end, the point angle and the lip relief angle when the drill is in grinding engagement with the grinding surface.

7. A machine for point grinding the end of a drill comprising a grinding wheel having an axis of rotation and a bevelled grinding surface rotating in a plane perpendicular to the axis of rotation with the angle of the bevel being selected to grind the drill end to a selected point angle, means fixedly supporting a drill end and adapted to move said drill into and out of grinding engagement with said grinding surface while positioning the cutting lip of the drill perpendicular with respect to an imaginary point described the rotating grinding surface at the time of grinding engagement therewith, means to selectively vary from said imaginary point fixed in the plane of rotation of said grinding surface the point of grinding engagement between the drill end and said grinding surface to selectively control the lip relief angle to be ground on the drill end, said means supporting the drill end for movement in a direction tangent to the selected point of grinding engagement, and means to rotate the drill about its axis while the same is in grinding engagement with the point of grinding engagement to grind the chisel edge angle, the point angle and the lip relief angle on the drill end.

8. A machine as in claim 7, said means to selectively vary the point of grinding engagement being adjustable to raise or lower the drill end in its tangent movement to cause the same to engage with said grinding surface at selected different points therealong spaced arcuately from said imaginary point to selectively vary the lip relief angle to be ground on the drill ends.

9. A machine for point grinding the end of a drill comprising a grinding wheel having a grinding surface rotating in a predetermined plane, means for supporting a drill substantially in a corresponding plane for rotation about its axis including means for locating the cutting lip of the drill parallel to an imaginary line on said grinding surface and indexing means to index each of the lands of the drill for grinding engagement with said grinding surface, means to move said supporting means and grinding surface tangentially relative to each other, means to correspondingly move the drill toward different points of grinding engagement with said grinding surface arcuately displaced from a corresponding line drawn through the axis of rotation of said grinding surface to cause the grinding of the point angle, chisel edge angle and lip relief angle on the drill, and said grinding surface being bevelled to the point angle desired to be ground on the drill.

* * * * *